US009932100B2

(12) United States Patent
Yamada

(10) Patent No.: US 9,932,100 B2
(45) Date of Patent: Apr. 3, 2018

(54) MARINE PROPULSION DEVICE

(71) Applicant: YAMAHA HATSUDOKI KABUSHIKI KAISHA, Iwata-shi, Shizuoka (JP)

(72) Inventor: Takayuki Yamada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 86 days.

(21) Appl. No.: 15/049,225

(22) Filed: Feb. 22, 2016

(65) Prior Publication Data

US 2016/0340012 A1 Nov. 24, 2016

(30) Foreign Application Priority Data

May 20, 2015 (JP) ..... 2015-102666

(51) Int. Cl.

| | |
|---|---|
| ***B63H 20/28*** | (2006.01) |
| ***F01P 7/16*** | (2006.01) |
| *F01P 3/00* | (2006.01) |
| *B63H 11/00* | (2006.01) |

(52) U.S. Cl.

CPC ..... *B63H 20/28* (2013.01); *F01P 7/167* (2013.01); *B63H 11/00* (2013.01); *F01P 3/00* (2013.01); *F01P 2050/04* (2013.01); *F01P 2070/10* (2013.01)

(58) Field of Classification Search

CPC ..... F01P 3/00; F01P 3/20; B63H 11/00
USPC .... 440/88 R, 88 N; 123/41.08, 41.29, 41.31, 123/41.74

See application file for complete search history.

(56) References Cited

U.S. PATENT DOCUMENTS

| | | | | |
|---|---|---|---|---|
| 2014/0242859 | A1* | 8/2014 | Ochiai | B63H 20/28 440/88 M |
| 2015/0197326 | A1* | 7/2015 | Peselli | B63H 21/383 114/337 |
| 2015/0367924 | A1* | 12/2015 | Davis | B63H 20/002 440/53 |
| 2015/0370252 | A1* | 12/2015 | Hanson | B60F 5/00 701/2 |

(Continued)

FOREIGN PATENT DOCUMENTS

JP 2014-163288 A 9/2014

*Primary Examiner* — Thomas G Black
*Assistant Examiner* — Wae L Louie
(74) *Attorney, Agent, or Firm* — Keating and Bennett, LLP

(57) ABSTRACT

A marine propulsion device includes an engine, a cylinder cooling pathway through which a cooling water passes, a water pump, an electromagnetic valve, a water pressure sensor, a water temperature sensor, and a controller. The engine includes a cylinder. The cylinder cooling pathway is disposed in an area surrounding the cylinder. The water pump supplies the cooling water to the cylinder cooling pathway from outside. The electromagnetic valve restricts a flow of the cooling pathway in the cylinder cooling pathway. The water pressure sensor detects a water pressure of the cooling water in the cylinder cooling pathway. The water temperature sensor detects a water temperature of the cooling water in the cylinder cooling pathway. The controller is configured or programmed to control an opening degree of the electromagnetic valve based on a detection value of the water pressure sensor and a detection value of the water temperature sensor.

20 Claims, 4 Drawing Sheets

(56) References Cited

U.S. PATENT DOCUMENTS

2016/0069624 A1* 3/2016 Rollins ..... F04D 25/028
415/122.1
2016/0340012 A1* 11/2016 Yamada ..... B63H 20/28

* cited by examiner

MARINE PROPULSION DEVICE

BACKGROUND OF THE INVENTION

1. Field of the Invention

The present invention relates to a marine propulsion device.

2. Description of the Related Art

A type of marine propulsion device including a catalyst, a cooling pathway, a pilot pathway, a restriction valve, and a thermostat is known in the art (see Japan Laid-open Patent Application Publication No. 2014-163288). The catalyst is disposed in an exhaust pathway connected to an engine. The cooling pathway is disposed in the surroundings of the engine and the exhaust pathway. The pilot pathway is disposed above the cooling pathway and is connected to the cooling pathway. The restriction valve is disposed in the pilot pathway. The thermostat is disposed downstream of the cooling pathway. In this type of marine propulsion device, when the amount of cooling water supplied to the cooling pathway is reduced, the restriction valve prevents the fluid from reversely flowing from the pilot pathway to the cooling pathway. With this configuration, the speed of discharging the cooling water in the surroundings of the catalyst is decelerated. Hence, degradation in catalyst cooling performance is prevented.

However, when the amount of cooling water supplied to the cooling pathway is reduced during driving of the engine in the above-described type of marine propulsion devices, the cooling water in the surroundings of the cylinders increases in temperature and therefore the thermostat is normally kept opened. With this mechanism, the speed of discharging the cooling water in the surroundings of the catalyst is decelerated as described above, but the speed of discharging the cooling water in the surroundings of the cylinders of the engine is not effectively decelerated.

Additionally, it is required to control cylinder cooling performance not only when the amount of the cooling water supplied to the cooling pathway is reduced but also during normal operation of the marine propulsion devices.

SUMMARY OF THE INVENTION

Preferred embodiments of the present invention provide a marine propulsion device in which cylinder cooling performance is more controllable.

A marine propulsion device according to a preferred embodiment of the present invention includes an engine, a cylinder cooling pathway through which a cooling water passes, a water pump, an electromagnetic valve, a water pressure sensor, a water temperature sensor, and a controller. The engine includes a cylinder. The cylinder cooling pathway is disposed in an area surrounding the cylinder. The water pump supplies the cooling water to the cylinder cooling pathway from outside the marine propulsion device. The electromagnetic valve restricts a flow of the cooling pathway in the cylinder cooling pathway. The water pressure sensor detects a water pressure of the cooling water in the cylinder cooling pathway. The water temperature sensor detects a water temperature of the cooling water in the cylinder cooling pathway. The controller is configured or programmed to control an opening degree of the electromagnetic valve based on a detection value of the water pressure sensor and a detection value of the water temperature sensor.

According to preferred embodiments of the present invention, it is possible to provide a marine propulsion device in which cylinder cooling performance is more controllable.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
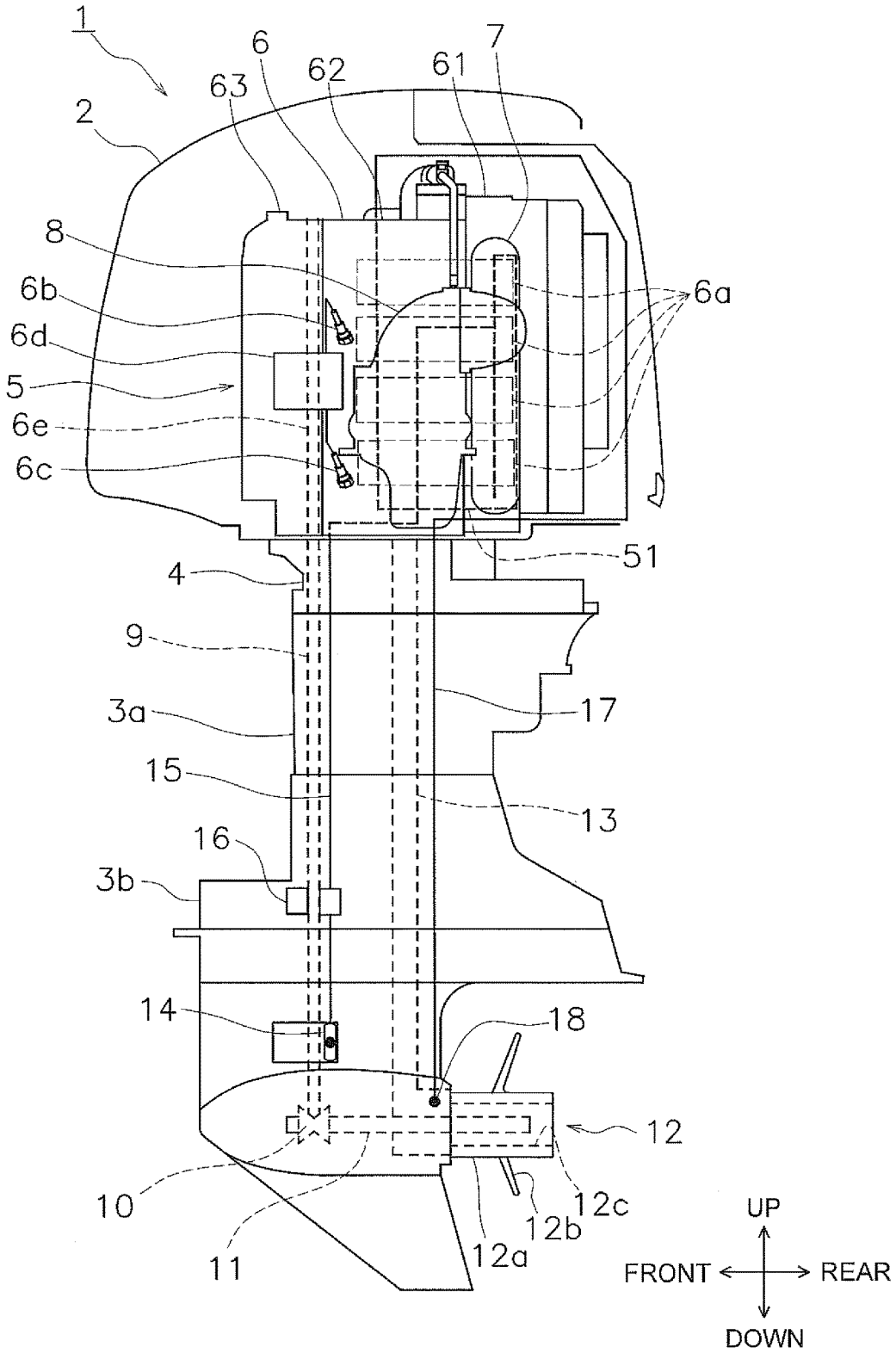
FIG. 1 is a schematic side view of a construction of a marine propulsion device.

A marine propulsion device 1 according to a preferred embodiment of the present invention is preferably an outboard motor attachable to a vessel body through a suspension device. FIG. 1 is a schematic side view of a construction of the marine propulsion device 1.

As shown in FIG. 1, the marine propulsion device 1 includes an engine cover 2, an upper casing 3*a*, a lower casing 3*b*, an exhaust guide 4, and an engine unit 5.

The engine cover 2, the upper casing 3*a*, and the engine unit 5 are fixed to the exhaust guide 4. The engine cover 2 is disposed over the exhaust guide 4. The upper casing 3*a* is disposed under the exhaust guide 4. The lower casing 3*b* is disposed under the upper casing 3*a*. In the present preferred embodiment, the engine cover 2, the upper casing 3*a*, the lower casing 3*b*, and the exhaust guide 4 define a housing of the marine propulsion device 1.

The engine unit 5 is disposed inside the engine cover 2. A cooling water pathway 51 is provided in the interior of the engine unit 5. The engine unit 5 includes an engine 6, an exhaust pipe 7, and a catalyst unit 8.

The engine 6 includes a cylinder head 61, a cylinder block 62, and a crank case 63. Four cylinders 6*a*, for example, are arranged in the interiors of the cylinder head 61 and the cylinder block 62. The four cylinders 6*a* are disposed in alignment in the up-and-down direction. In the present preferred embodiment, each of the four cylinders 6*a* preferably extends in the horizontal direction, for example. A water temperature sensor 6*b*, a water pressure sensor 6*c*, and an engine ECU 6*d* (an example of a "controller") are attached to the cylinder block 62. The water temperature sensor 6*b* and the water pressure sensor 6*c* are electrically connected to the engine ECU 6*d*. A crankshaft 6*e* is disposed inside the crank case 63. The crankshaft 6*e* extends in the up-and-down direction.

The exhaust pipe 7 is connected to the cylinder head 61. Exhaust gas discharged from the four cylinders 6*a* passes through the interior of the exhaust pipe 7. The catalyst unit 8 is connected to the exhaust pipe 7 and the cylinder block 62 of the engine 6. The catalyst unit 8 accommodates a catalyst 81 (shown not in FIG. 1 but in FIG. 2). For example, a three-way catalyst or other type of catalyst is available as the catalyst 81. Exhaust gas, flowing into the catalyst unit 8 from the exhaust pipe 7, passes through the interior of the catalyst unit 8 from top to bottom. When passing through the interior of the catalyst unit 8, exhaust gas is purified by the catalyst 81. The purified exhaust gas flows out to an exhaust channel (not shown in the drawings) within the cylinder block 62.

As shown in FIG. 1, the marine propulsion device 1 further includes a drive shaft 9, a bevel gear 10, a propeller shaft 11, a propeller 12, and an exhaust pathway 13.

The drive shaft 9 extends in the up-and-down direction in the interiors of the upper casing 3*a* and the lower casing 3*b*. The upper end of the drive shaft 9 is coupled to the lower end of the crankshaft 6*e* of the engine 6. The lower end of the drive shaft 9 is coupled to the propeller shaft 11 through the bevel gear 10. The propeller shaft 11 extends in the back-and-forth direction in the interior of the lower casing 3*b*. The rear end of the propeller shaft 11 protrudes from the lower casing 3*b* and is coupled to the propeller 12. The propeller 12 includes a propeller boss 12*a*, blades 12*b*, and an exhaust port 12*c*. The propeller boss 12*a* is fixed to the propeller shaft 11. The blades 12*b* are disposed on the outer peripheral surface of the propeller boss 12*a*. The exhaust port 12*c* is open at the rear end surface of the propeller boss 12*a*.

The exhaust pathway 13 extends from the engine 6 to the propeller boss 12*a* of the propeller 12 through the interiors of the exhaust guide 4, the upper casing 3*a*, and the lower casing 3*b*. Exhaust gas discharged from the engine 6 flows through the cylinders 6*a*, the exhaust pipe 7, the catalyst unit 8, the cylinder block 62, and the exhaust pathway 13, in this order, and is then discharged into the water through the exhaust port 12*c*.

As shown in FIG. 1, the marine propulsion device 1 further includes a water intake port 14, a water supply pathway 15, a water pump 16, a water draining pathway 17, and a water draining port 18.

The water intake port 14 is provided in the lower casing 3*b*. The water intake port 14 is open to the outer surface of the lower casing 3*b*. The water supply pathway 15 is connected to the water intake port 14 and the cooling water pathway 51 inside the engine unit 5. The water pump 16 is attached to the drive shaft 9. The suction force of the water pump 16 increases as the rotational speed of the drive shaft 9 increases, in other words, as the rotational speed of the engine 6 gets higher. The water pump 16 takes in water from outside the housing, as the cooling water, into the water supply pathway 15 through the water intake port 14, and supplies the taken-in water to the cooling water pathway 51. The water draining pathway 17 is connected to the cooling water pathway 51 and the water draining port 18. The water draining port 18 is provided in the lower end of the exhaust pathway 13. The cooling water, taken in through the water intake port 14, flows through the water supply pathway 15, the cooling water pathway 51, the water draining pathway 17, and the water draining port 18, in this order, and is then discharged into the water through the exhaust port 12*c* of the propeller 12.

Figure 2:
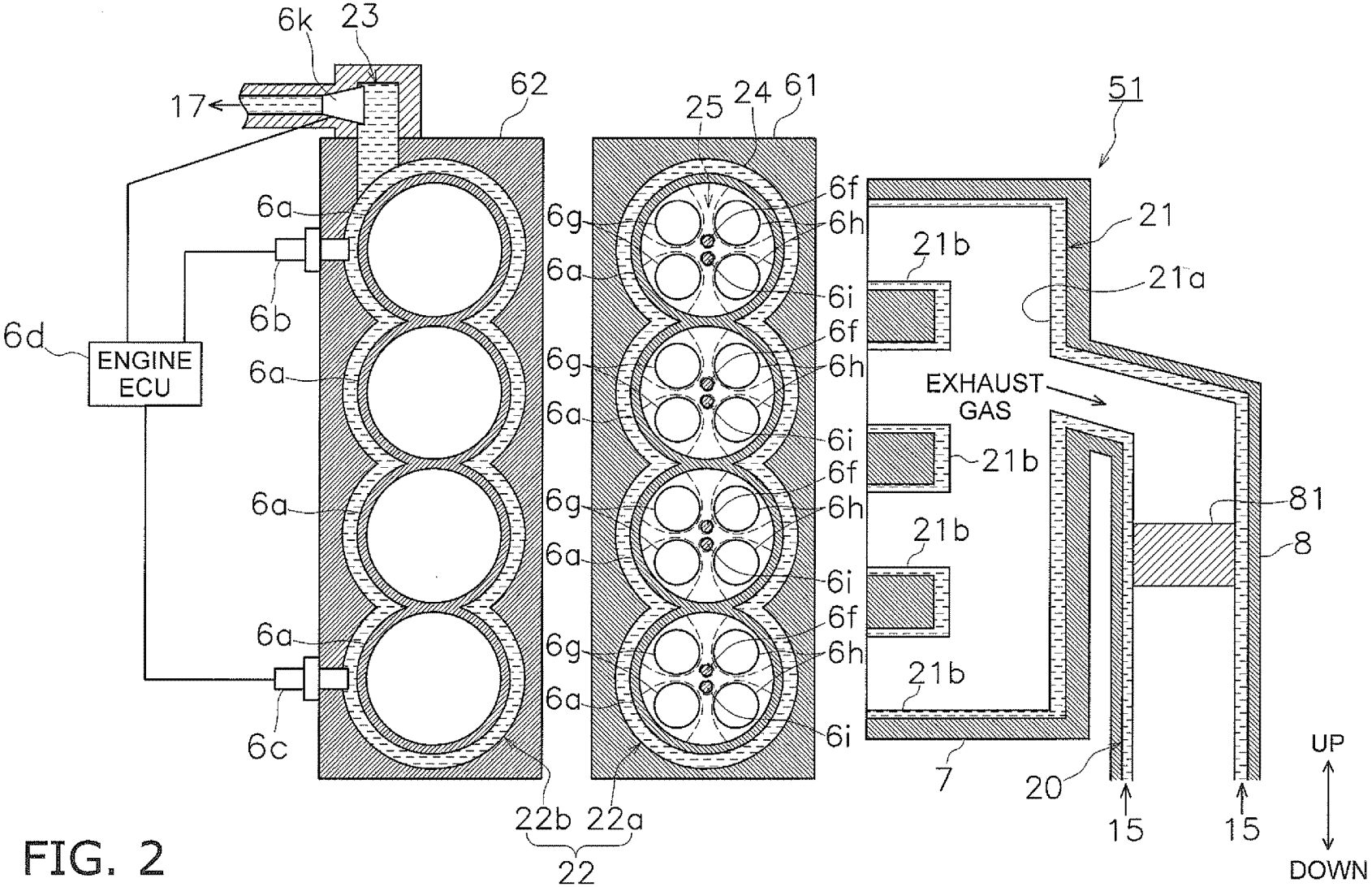
FIG. 2 is a schematic cross-sectional view of an engine unit and shows a construction of a cooling water pathway.

Next, the cooling water pathway 51 provided in the interior of the engine unit 5 will be explained. FIG. 2 is a schematic cross-sectional view of the engine unit 5 and shows a construction of the cooling water pathway 51. In the following explanation, "upstream" and "downstream" are terms defined based on the flow direction of the cooling water. The side of the water intake port 14 will be referred to as "upstream", whereas the side of the water draining port 18 will be referred to as "downstream".

As shown in FIG. 2, the cooling water pathway 51 includes a catalyst cooling pathway 20, an exhaust pipe cooling pathway 21, a cylinder cooling pathway 22, and a downstream pathway 23. The exhaust pipe cooling pathway 21 is located downstream of the catalyst cooling pathway 20. The cylinder cooling pathway 22 is located downstream of the exhaust pipe cooling pathway 21. The downstream pathway 23 is located downstream of the cylinder cooling pathway 22. The cooling water, flowing in from the water supply pathway 15, flows through the catalyst cooling pathway 20, the exhaust pipe cooling pathway 21, the cylinder cooling pathway 22, and the downstream pathway 23, in this order, and then flows out to the water draining pathway 17.

The catalyst cooling pathway 20 is provided in the interior of the catalyst unit 8. The catalyst cooling pathway 20 extends to the upper end of the water supply pathway 15. The catalyst cooling pathway 20 is disposed in an area surrounding the catalyst 81. The cooling water, flowing in from the water supply pathway 15, upwardly flows through the interior of the catalyst cooling pathway 20.

The exhaust pipe cooling pathway 21 is provided in the interior of the exhaust pipe 7. The exhaust pipe cooling pathway 21 extends to the upper end of the catalyst cooling pathway 20. The exhaust pipe cooling pathway 21 includes a main pathway 21*a* and four branch pathways 21*b*. The main pathway 21*a* extends in the up-and-down direction. The four branch pathways 21*b* respectively extend from the main pathway 21*a* toward the cylinder head 61. The four branch pathways 21*b* are preferably disposed in alignment in the up-and-down direction. The cooling water, flowing in from the catalyst cooling pathway 20, flows through the interior of the main pathway 21*a*, is branched off up and down, and then flows through the interiors of the four branch pathways 21*b* in the horizontal direction.

The cylinder cooling pathway 22 includes a cylinder head cooling pathway 22*a* and a cylinder block cooling pathway 22*b*.

The cylinder head cooling pathway 22*a* is provided in the interior of the cylinder head 61. The cylinder head cooling pathway 22*a* continues to the four branch pathways 21*b* of the exhaust pipe cooling pathway 21. The cylinder head cooling pathway 22*a* includes a lateral cooling pathway 24 and injector cooling pathways 25. The lateral cooling pathway 24 is disposed in an area surrounding the respective four cylinders 6*a*. Each injector cooling pathway 25 is disposed in an area surrounding an injector 6*f* provided for each of the four cylinders 6*a*. Each injector cooling pathway 25 extends to the lateral cooling pathway 24, while extending through gaps among intake ports 6*g*, exhaust ports 6*h*, and a spark plug 6*i*, which are provided for each of the four cylinders 6*a*. The cooling water, flowing in from the exhaust pipe cooling pathway 21, downwardly flows through the interior of the lateral cooling pathway 24 and that of the injector cooling pathway 25.

The cylinder block cooling pathway 22*b* is provided in the interior of the cylinder block 62. The cylinder block cooling pathway 22*b* extends to the lower end of the cylinder head cooling pathway 22*a*. The cylinder block cooling pathway 22*b* is disposed in an area surrounding the respective four cylinders 6*a*. The cooling water, flowing in from the cylinder head cooling pathway 22*a*, upwardly flows through the interior of the cylinder block cooling pathway 22*b*.

The water temperature sensor 6*b*, attached to the cylinder block 62, detects the water temperature of the cooling water flowing through the interior of the cylinder block cooling pathway 22*b*. The water pressure sensor 6*c*, attached to the cylinder block 62, detects the water pressure of the cooling water flowing through the interior of the cylinder block cooling pathway 22*b*. The water temperature sensor 6*b* transmits a detection value, indicating the water temperature of the cooling water, to the engine ECU 6*d*. The water pressure sensor 6*c* transmits a detection value, indicating the water pressure of the cooling water, to the engine ECU 6*d*.

The downstream pathway 23 is provided on the upper side of the cylinder block 62. The downstream pathway 23 extends to the upper end of the cylinder block cooling pathway 22*b*. The downstream pathway 23 extends to the water draining pathway 17. An electromagnetic valve 6*k* is disposed in the downstream pathway 23. The electromagnetic valve 6*k* is preferably disposed higher than the four cylinders 6*a*. The electromagnetic valve 6*k* is preferably disposed higher than the cylinder block 62. The electromagnetic valve 6*k* is preferably disposed downstream of the injector cooling pathway 25. The electromagnetic valve 6*k* is preferably disposed downstream of the cylinder cooling pathway 22. The flow of the cooling water in the cylinder cooling pathway 22 is restricted in conjunction with opening and closing of the electromagnetic valve 6*k*. The opening degree of the electromagnetic valve 6*k* (hereinafter referred to as "valve opening degree") may be controllable to be only either a fully opened degree (valve opening degree=100) or a fully closed degree (valve opening degree=0). Alternatively, the valve opening degree may be controllable in a stepwise manner in a range from the fully opened degree to the fully closed degree. The engine ECU 6*d* is configured or programmed to control the valve opening degree.

The engine ECU 6*d* determines the water temperature of the cooling water flowing through the interior of the cylinder block cooling pathway 22*b* based on the detection value of the water temperature sensor 6*b*. The engine ECU 6*d* determines the water pressure of the cooling water in the cylinder cooling pathway 22 based on the detection value of the water pressure sensor 6*c*. The engine ECU 6*d* determines the rotational speed of the engine 6 (hereinafter referred to as "engine rotational speed") based on a detection value of an engine rotational speed sensor (not shown in the drawings).

In the present preferred embodiment, the engine ECU 6*d* is configured or programmed to control the valve opening degree of the electromagnetic valve 6*k*, and accordingly, make the electromagnetic valve 6*k* function as an air vent valve, a thermostat, and an overheat preventing device.

Figure 3:
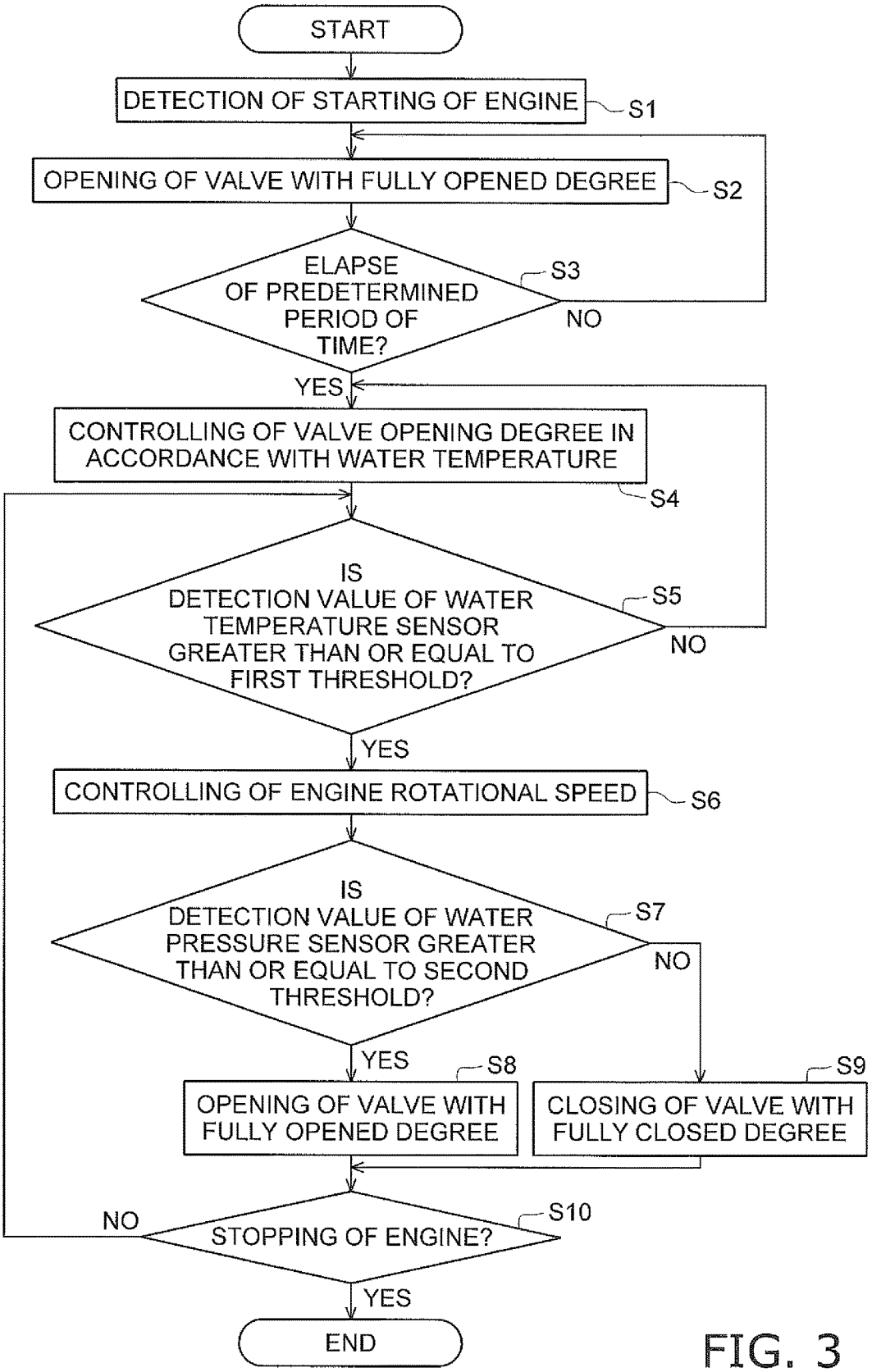
FIG. 3 is a flowchart for explaining a method of controlling a valve opening degree by an engine ECU.

FIG. 3 is a flowchart for explaining a method of controlling the valve opening degree by the engine ECU 6*d*.

In Step S1, the engine ECU 6*d* detects starting of the engine 6. When the engine 6 is started, the water pump 16 is driven so that the cooling water begins to be supplied to the cooling water pathway 51.

In Step S2, the engine ECU 6*d* opens the electromagnetic valve 6*k* to the fully opened degree. In the present preferred embodiment, the electromagnetic valve 6*k* is disposed higher than the cylinder block 62, and is also disposed most downstream in the cooling water pathway 51 (i.e., downstream of the cylinder cooling pathway 22). Therefore, by opening the electromagnetic valve 6*k* to the fully opened degree, it is possible to quickly release air in the cooling water pathway 51 and fill up the cooling water pathway 51 with the cooling water. Accordingly, the electromagnetic valve 6*k* functions as an air vent valve.

In Step S3, the engine ECU 6*d* determines whether or not a predetermined period of time has elapsed since opening of the electromagnetic valve 6*k* to the fully opened degree. When it is determined that the predetermined period of time has elapsed, the process proceeds to Step S4. When it is determined that the predetermined period of time has not elapsed yet, the process returns to Step S2.

In Step S4, the engine ECU 6*d* controls the valve opening degree of the electromagnetic valve 6*k* in accordance with the detection value of the water temperature sensor 6*b*. When the detection value of the water temperature sensor 6*b* is greater than or equal to a predetermined value, the engine ECU 6*d* controls the valve opening degree in an open direction. By contrast, when the detection value of the water temperature sensor 6*b* is less than the predetermined value, the engine ECU 6*d* controls the valve opening degree in a closed direction. Accordingly, the electromagnetic valve 6*k* functions as a thermostat.

In Step S5, the engine ECU 6*d* determines whether or not the detection value of the water temperature sensor 6*b* is greater than or equal to an overheat threshold (first threshold). The overheat threshold is preferably set to a temperature at which thermal damage could occur in the overheated engine 6. When it is determined that the detection value of the water temperature sensor 6*b* is not greater than or equal to the overheat threshold, the process returns to Step S4. When it is determined that the detection value of the water temperature sensor 6*b* is greater than or equal to the overheat threshold, the process proceeds to Step S6.

In Step S6, the engine ECU 6*d* decelerates the engine rotational speed to a low rotational speed around which low-speed navigation is enabled. The engine ECU 6*d* is preferably configured or programmed to stop the engine 6 when the process goes through Steps S7 to S10 (to be described) and returns to Step S6 (i.e., when the overheated state of the engine 6 continues).

Figure 4:
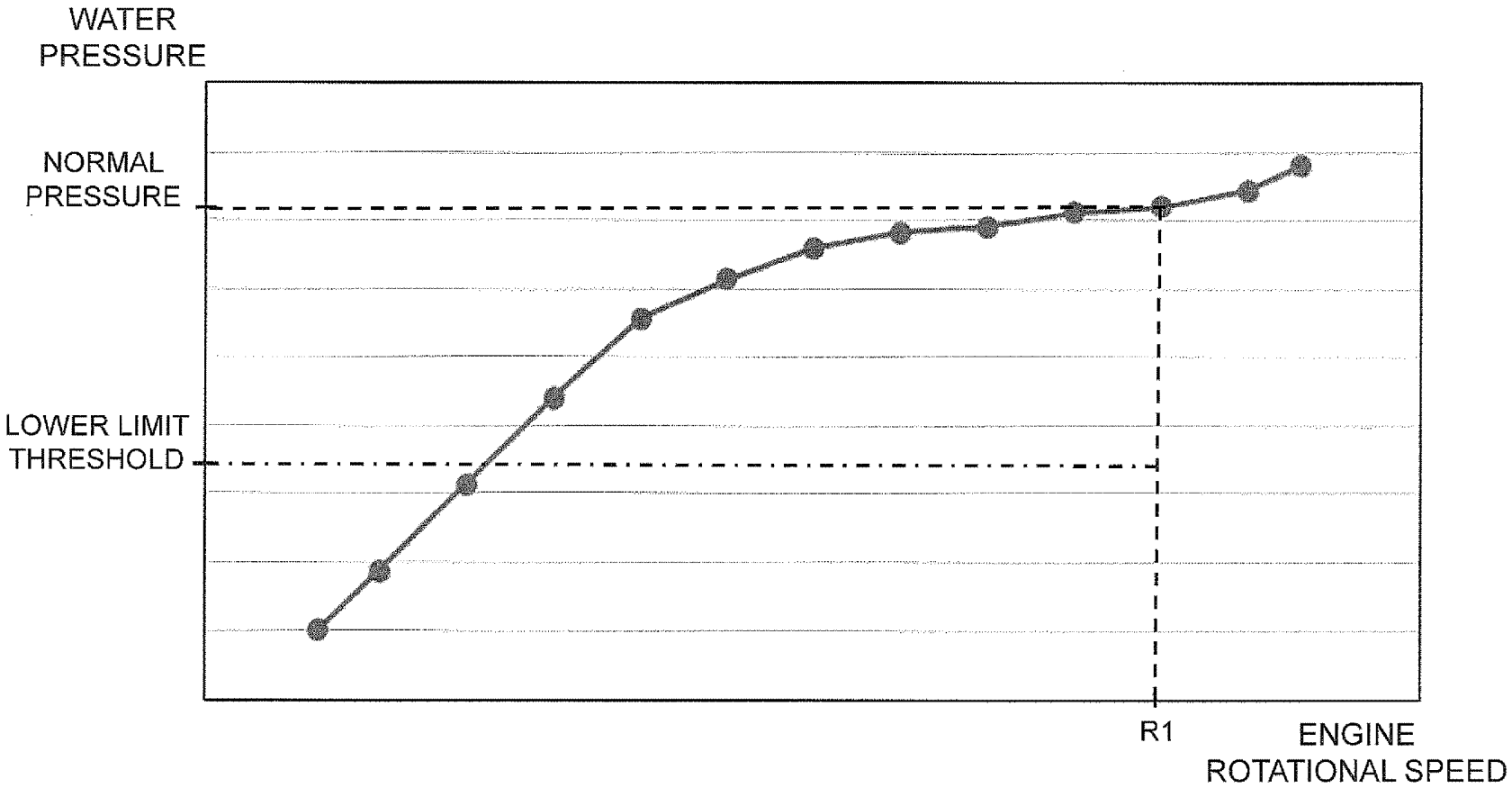
FIG. 4 is an exemplary map that defines a relationship between engine rotational speed and normal water pressure of cooling water.

In Step S7, the engine ECU 6*d* determines whether or not the detection value of the water pressure sensor 6*c* is greater than or equal to a lower limit threshold (second threshold). The lower limit threshold is lower than the value of normal water pressure of the cooling water in the cylinder cooling pathway 22. The lower limit threshold is the value of water pressure at which the overheated engine 6 is at least cooled. The normal water pressure is a water pressure determined based on a relationship between the engine rotational speed and the valve opening degree when the cylinder cooling pathway 22 is filled with the cooling water. The engine ECU 6*d* preferably determines the lower limit threshold by referring to a map that defines a relationship between the engine rotational speed and both the normal water pressure and the lower limit threshold as shown in FIG. 4. In FIG. 4, the lower limit threshold is set to be about 50%, for example, of the normal water pressure when the engine rotational speed is R1.

In Step S7, when it is determined that the detection value of the water pressure sensor 6*c* is greater than or equal to the lower limit threshold, a condition is produced that the cooling water flows through the interior of the cylinder cooling pathway 22 and the engine 6 is at least cooled. In response to this, the engine ECU 6*d* keeps opening the electromagnetic valve 6*k* to the fully opened degree in Step S8. Accordingly, the pressure loss of the cooling water flowing through the cooling water pathway 51 is significantly reduced or prevented. Hence, the flow rate of the cooling water increases, and the engine 6 is thus cooled.

In Step S7, when it is determined that the detection value of the water pressure sensor 6*c* is not greater than or equal to the lower limit threshold, a condition is produced that the cooling water hardly flows through the interior of the cylinder cooling pathway 22 due to the water intake port 14 being clogged by foreign objects such as seaweed or a breakdown of the water pump 16, and therefore, the engine 6 cannot be cooled. In response to this, the engine ECU 6*d* keeps closing the electromagnetic valve 6*k* to the fully closed degree in Step S9. Accordingly, the cooling water is accumulated in the cylinder cooling pathway 22. Hence, the occurrence of thermal damage in the overheated engine 6 is prevented.

In Step S10, the engine ECU 6*d* determines whether or not the engine 6 has stopped. That the engine 6 has stopped includes situations in which the engine 6 has been forcibly stopped by the engine ECU 6*d* in the above-described Step S6 and in which the engine 6 has been voluntarily stopped by an operator. When stopping of the engine 6 is not detected, the process returns to Step S5. When stopping of the engine 6 is detected, the process ends.

Preferred embodiments of the present invention have been described above. However, the present invention is not limited to the above-described preferred embodiments, and a variety of changes can be made without departing from the scope of the present invention.

The engine 6 preferably includes four cylinders 6*a*. However, the number of cylinders is not limited to four. The engine 6 may include three or less cylinders, or alternatively, may include five or more cylinders.

The water temperature sensor 6*b* preferably detects the water temperature of the cooling water flowing through the cylinder cooling pathway 22. However, the water temperature sensor 6*b* may indirectly detect the water temperature. For example, the water temperature sensor 6*b* may detect the temperature in an area surrounding the cylinder block 62 or the wall temperature of the cylinder block 62.

The water temperature sensor 6*b* is preferably attached to the cylinder block 62, but alternatively, may be attached to the cylinder head 61.

The water pressure sensor 6*c* is preferably attached to the cylinder block 62, but alternatively, may be attached to the cylinder head 61. Yet alternatively, without attaching any water pressure sensor to the engine 6, the electromagnetic valve 6*k* may be utilized as a thermostat.

The engine ECU 6*d* causes the electromagnetic valve 6*k* to function as an air vent valve, but this configuration is not necessarily required. Therefore, the electromagnetic valve 6*k* is not required to be disposed higher than the cylinder block 62, and is not required to be located most downstream in the cooling water pathway 51. The engine ECU 6*d* causes the electromagnetic valve 6*k* to function as an overheat preventing device, but this configuration is not necessarily required. In this case, the electromagnetic valve 6*k* is not required to be disposed higher than the cylinder block 62 and is not required to be located most downstream in the cooling water pathway 51. Even in these alternatives, the electromagnetic valve 6*k* functions as a thermostat with precision by using the detection value of the water temperature sensor 6*b* and the detection value of the water pressure sensor 6*c*.

The marine propulsion device 1 is preferably an outboard motor attachable to the vessel body, but alternatively, may be a jet propulsion device, an inboard propulsion device, or so forth.

The cooling water pathway 51 may be provided with a restriction valve disposed over the exhaust pipe cooling pathway 21. With a configuration in which the restriction valve is closed when the flow rate of the cooling water in the exhaust pipe cooling pathway 21 is reduced, the cooling water is accumulated in the exhaust pipe cooling pathway 21 and the catalyst cooling pathway 20, so that the catalyst 81 is cooled. The detailed construction of the restriction valve is described in Japan Laid-open Patent Application Publication No. 2014-163288. Therefore, the description of Japan Laid-open Patent Application Publication No. 2014-163288 corresponding to the construction of the restriction valve and its periphery is herein incorporated by its reference in its entirety.

In Step S2 of FIG. 3, the engine ECU 6*d* is configured or programmed to open the electromagnetic valve 6*k* to the fully opened degree. Alternatively, when the valve opening degree is controllable in multiple stages, the engine ECU 6*d* may be configured or programmed to control the valve opening degree further in the open direction than the status quo.

In Step S8 of FIG. 3, the engine ECU 6*d* is configured or programmed to open the electromagnetic valve 6*k* to the fully opened degree. Alternatively, when the valve opening degree is controllable in multiple stages, the engine ECU 6*d* may be configured or programmed to control the valve opening degree further in the open direction than the status quo.

In Step S9 of FIG. 3, the engine ECU 6*d* is configured or programmed to close the electromagnetic valve 6*k* to the fully closed degree. Alternatively, when the valve opening degree is controllable in multiple stages, the engine ECU 6*d* may be configured or programmed to control the valve opening degree further in the closed direction than the status quo.

In Step S3 of FIG. 3, the engine ECU 6*d* is configured or programmed to determine whether or not the predetermined period of time has elapsed. Alternatively, the engine ECU 6*d* may be configured or programmed to determine whether or not the detection value of the water pressure sensor 6*c* has become greater than or equal to a predetermined value. In this case, the process proceeds to Step S4 when it is determined that the detection value of the water pressure sensor 6*c* has become greater than or equal to the predetermined value. By contrast, the process returns to Step S2 when the detection value of the water pressure sensor 6*c* has not become the predetermined value or greater.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an engine including a cylinder;

a cylinder cooling pathway through which a cooling water passes, the cylinder cooling pathway surrounding the cylinder;

a water pump that supplies the cooling water to the cylinder cooling pathway from outside of the marine propulsion device;

an electromagnetic valve that restricts a flow of the cooling water in the cylinder cooling pathway;

a water pressure sensor that detects a water pressure of the cooling water in the cylinder cooling pathway;

a water temperature sensor that detects a water temperature of the cooling water in the cylinder cooling pathway; and a controller configured or programmed to control an opening degree of the electromagnetic valve based on a detection value of the water pressure sensor and a detection value of the water temperature sensor.

2. The marine propulsion device according to claim 1, wherein the controller is configured or programmed to control the opening degree of the electromagnetic valve in an open direction when the detection value of the water temperature sensor is greater than a first threshold and the detection value of the water pressure sensor is greater than or equal to a second threshold.

3. The marine propulsion device according to claim 2, wherein the controller is configured or programmed to determine the second threshold in accordance with a rotational speed of the engine.

4. The marine propulsion device according to claim 3, wherein the controller is configured or programmed to determine the second threshold with reference to a map defining a relationship between the rotational speed of the engine and the second threshold.

5. The marine propulsion device according to claim 1, wherein the controller is configured or programmed to control the opening degree of the electromagnetic valve in a closed direction when the detection value of the water temperature sensor is greater than a first threshold and the detection value of the water pressure sensor is lower than a second threshold.

6. The marine propulsion device according to claim 1, wherein the water temperature sensor is integral with the electromagnetic valve.

7. The marine propulsion device according to claim 1, wherein the controller is configured or programmed to control the opening degree of the electromagnetic valve in an open direction when starting the engine.

8. The marine propulsion device according to claim 7, wherein the controller is configured or programmed to keep controlling the opening degree of the electromagnetic valve in the open direction until the detection value of the water pressure sensor becomes greater than or equal to a predetermined value.

9. The marine propulsion device according to claim 1, further comprising:

an exhaust pipe through which an exhaust gas discharged from the engine passes; and an exhaust pipe cooling pathway in an interior of the exhaust pipe; wherein the cooling water flows from the exhaust pipe cooling pathway to the cylinder cooling pathway; and the electromagnetic valve is disposed downstream of the cylinder cooling pathway.

10. The marine propulsion device according to claim 9, wherein the engine includes a crankshaft extending in an up-and-down direction; and the electromagnetic valve is disposed higher than the cylinder.

11. The marine propulsion device according to claim 1, wherein the electromagnetic valve is disposed downstream of the cylinder cooling pathway.

12. The marine propulsion device according to claim 1, wherein the engine includes an injector;

the cylinder cooling pathway includes an injector cooling pathway in an area surrounding the injector; and the electromagnetic valve is disposed downstream of the injector cooling pathway.

13. The marine propulsion device according to claim 1, further comprising:

a housing accommodating the engine and the exhaust pipe, the housing including a water intake port; wherein the water pump takes in water through the water intake port from outside the housing as the cooling water.

14. A marine propulsion device comprising:

an engine including a cylinder;

a cylinder cooling pathway through which a cooling water passes, the cylinder cooling pathway surrounding the cylinder;

a water pump that supplies the cooling water to the cylinder cooling pathway from outside the marine propulsion device;

an electromagnetic valve disposed downstream of the cylinder cooling pathway, the electromagnetic valve restricting a flow of the cooling water in the cylinder cooling pathway;

a water temperature sensor that detects a water temperature of the cooling water in the cylinder cooling pathway; and a controller configured or programmed to control an opening degree of the electromagnetic valve at least based on a detection value of the water temperature sensor.

15. The marine propulsion device according to claim 14, wherein the water temperature sensor is integral with the electromagnetic valve.

16. The marine propulsion device according to claim 14, wherein the controller is configured or programmed to control the opening degree of the electromagnetic valve in an open direction when starting the engine.

17. The marine propulsion device according to claim 14, further comprising:

an exhaust pipe through which an exhaust gas discharged from the engine passes; and an exhaust pipe cooling pathway in an interior of the exhaust pipe; wherein the cooling water flows from the exhaust pipe cooling pathway to the cylinder cooling pathway.

18. The marine propulsion device according to claim 17, wherein the engine includes a crankshaft extending in an up-and-down direction; and the electromagnetic valve is disposed higher than the cylinder in the up-and-down direction.

19. The marine propulsion device according to claim 14, wherein the engine includes an injector;

the cylinder cooling pathway includes an injector cooling pathway disposed in an area surrounding the injector; and the electromagnetic valve is disposed downstream of the injector cooling pathway.

20. The marine propulsion device according to claim 14, further comprising:

a housing accommodating the engine and the exhaust pipe, the housing including a water intake port; wherein the water pump takes in water through the water intake port from outside the housing as the cooling water.

* * * * *